United States Patent [19]

Detje

[11] 4,226,350

[45] Oct. 7, 1980

[54] POCKET ORGANIZER

[76] Inventor: Henry Detje, 967 Marion St., Denver, Colo. 80218

[21] Appl. No.: 950,628

[22] Filed: Oct. 12, 1978

[51] Int. Cl.[2] ..... A44B 15/00

[52] U.S. Cl. ..... 224/247; 24/3 K; 24/116 R; 70/456 R; 70/459; 224/919

[58] Field of Search ..... 224/5 R, 5 C, 5 A, 5 B, 224/26 R, 26 B, 5 H, 242, 255, 245, 247, 248, 252, 253, 256, 914, 919; 24/116 A, 3 K, 3 M, 4, 3 R; 211/89; 248/309, 316 D, 309 A; 70/456 R, 456 A, 457, 458, 459

[56] References Cited

U.S. PATENT DOCUMENTS

| | | | |
|---|---|---|---|
| 867,255 | 10/1907 | Dietz | 24/3 K UX |
| 1,422,872 | 7/1922 | Loman | 24/3 M |
| 2,226,502 | 12/1940 | Platt | 24/116 A |
| 3,299,679 | 1/1967 | Anderson | 70/459 |
| 3,771,341 | 11/1973 | Laufer | 70/456 B |

FOREIGN PATENT DOCUMENTS

| | | | |
|---|---|---|---|
| 473444 | 7/1952 | Italy | 70/456 B |

*Primary Examiner*—Robert J. Spar
*Assistant Examiner*—Jerold M. Forsberg
*Attorney, Agent, or Firm*—Kyle W. Rost

[57] ABSTRACT

A keyholder adapted for use as an addition to a garment has a body formed from a backing plate with a retainer plate attached at an acute angle to form a V-shaped trough. Key loop openings in the retainer plate have a trapezoidal slot opening at its longer base to the free edge of the retainer plate, and the short base opens to a circular aperture. The backing plate is provided with a cavity or hole positioned to cooperate with the circular aperture in retaining a spherical key loop therebetween. The sphere is relatively large, such as one-quarter inch or more, so that it provides a caming surface that allows removal or insertion of the sphere in the keyholder body with moderate forces.

6 Claims, 5 Drawing Figures

POCKET ORGANIZER

BACKGROUND OF THE INVENTION

1. Field of the Invention

The invention relates generally to locks and more specifically to keyholders, especially to parallel key loops, coaxially mounted, and individually moveable.

2. Description of the Prior Art

Keyholders of many designs have been created that are capable of holding keys or like objects on different key loops such that each key loop is capable of being individually removed. It has uniformly been the practice to attach such key loops to a plate having appropriate means thereon for retaining the individual loops in a releasable fashion. This plate, in turn, is intended to be fastened to a leather snap pouch or plastic key case. The prior art in this way taught the portable carrying of keys in a small package that might be dropped into the pocket or purse.

Among the known prior art patents is U.S. Pat. No. 2,550,135 teaching a sphere on a key loop; U.S. Pat. No. 3,008,323 teaching a single metal blank bent to form a key plate with integral spring finger for retaining the key loops in the plate; U.S. Pat. No. 3,132,504 teaching another one-piece metal key plate with spring finger; and U.S. Pat. No. 3,564,881 teaching a one-piece molded plastic key plate.

Although the art has taught such a variety of key plate constructions, all have been directed to the key package concept wherein the entire key plate is portable and adapted to be removed from the pocket or purse before any key is removed or otherwise used. For this reason, each key loop has been attached by a rigid wire to a sphere of small diameter, such as one-eighth inch; and the key plate has been provided with a circular hole and a radiating slot with the intention that the sphere be inserted through the hole and forced to slide through the slot until the sphere is engaged in some sort of retainer. Such an arrangement has been satisfactory in instances where the user has two hands available and is willing to direct considerable attention to the process of removing or replacing the key loop with the key plate.

Considerable force has been required to remove a key loop from a key plate for the reason that keys are relatively heavy and might otherwise cause the key loop to become unintentionally disengaged from the plate as the result of normal vibrations and jarring that result from typical handling. Consequently, the actual removal of prior art key loops from key plates is quite rare, and usually is reserved for special circumstances where it is unavoidable to separate one key from the remaining keys on other key loops. The result is that users will use each key while it remains attached to the keyholder, and the entire keyholder, including all other keys, will hang from the key in use. This situation provides an added reason why it is necessary for each key loop to be strongly connected to the key plate.

A self-defeating situation has been created in the key package concept since, as described above, the keys must be retained against inadvertent loss from the keyholder and users often find it more convenient to not separate a key for use since removal is difficult Consequently, the keyholder must also allow each key loop to support the entire remaining key holder for those times when the key in use is not separated.

The key package concept also leads to unpleasant lumpiness in the user's pocket, or allows the keyholder to become mislocated in the user's purse. This amounts to an inconvenience when only keys are involved, but often other objects are carried on a key chain and actual damage is known to occur. For instance, a pocket watch is often carried on a key chain, and when such a watch settles to the bottom of a pocket or purse, a considerable amount of lint or dirt may enter the watch. Jewelers have often commented on the deleterious effect resulting when a watch is carried in a pocket or purse. Also, heavy objects tend to wear out pockets.

The above problems relate in general to all prior art key holders employing the package concept whereby keys are carried in bulk and may be used in bulk as well. The invention described herein provides a remedy for all of the disclosed matters.

SUMMARY OF THE INVENTION

A keyholder formed from a synthetic material such as plastic or nylon has a backing plate and a retainer plate that meet at an acute angle, preferably between 20 and 45 degrees, and thereby creates a V-shaped trough. The retainer plate has a free edge opposite from the apex of the trough, and this edge is interrupted by one or more key loop openings. Each key loop opening has a keyhole shape with a trapezoidal slot immediately adjacent to the free edge, the longer base of the trapezoid being colinear with the free edge. The shorter base of the trapezoid is closer to the apex of the trough and opens into a circular aperture portion of the keyhole shape. The backing plate has a cavity or hole located approximately opposite to the circular aperture of the retainer plate, such that the normal axes of each opening intersect. A key loop has a sphere sized to be partially engaged in the circular openings, and it will therefore be understood that when the sphere is so engaged, the normal axes of the openings are each a radius of the sphere. The size of the sphere is at least one-quarter inch and preferably larger so that the sphere can be handled by tactile perception only to insert the sphere through the open end of the trough and along a trapezoidal slot until engaged with the openings. The backing plate and retainer plate may be integral portions of a single sheet of material folded at the apex of the trough.

The main object of the invention is to create a keyholder that is operable by one hand and solely by tactile perception, if desired. The trapezoidal slots are thus easily detected by the fingers and the sphere of the key loop may be inserted therein by guiding the sphere along the open end of the trough. This eliminates the common requirement of the prior art that a spherical key loop be threaded through an opening prior to the time that the sphere is engaged in a retainer.

Another object of the invention is to create a keyholder that is able to support the weight of a suspended key solely the firmness of the connection between the sphere and the keyholder body, while at the same time allowing the sphere to be removed or reinserted into the body with moderate effort.

A further object is to create a keyholder that can be adapted as an attachment to clothing and can be operated with the confines of a pocket for removal or replacement of the keys.

DESCRIPTION OF THE PREFERRED EMBODIMENT

Figure 1:
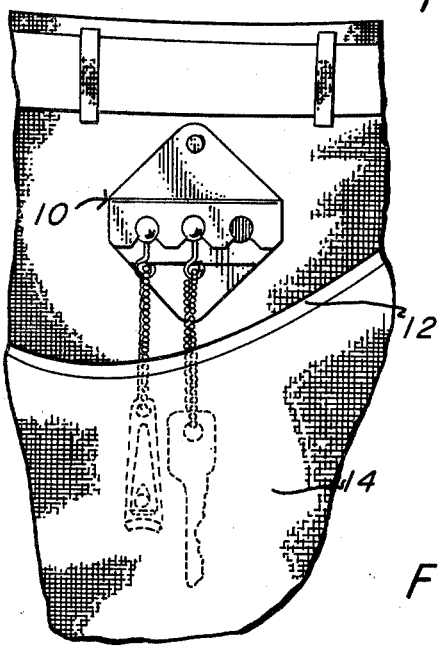
FIG. 1 is a perspective view of the invention attached near a pocket on a garment.

The invention relates to a keyholder that of necessity provides an organized location for the transport of keys or like objects, but of necessity is incapable of serving as a portable key package wherein a key may be used while remaining attached to the keyholder. Thus, the keys may be organized and located by the holder, but they are removed for use and easily replaced after use. The typical user will employ the keyholder 10, FIG. 1, as a clothing accessory that is connected to a garment above or immediately within a pocket opening, for example at the opening 12 to a pocket in pants 14. Alternative pockets could be equally well complimented by the keyholder, or the same device may be connected to the wall of a purse or other carrying bag.

The keyholder is constructed from a body 16 adapted to receive and retain the enlarged head 18 of a key loop 20. The body 16 has means associated therewith for attaching the body to a garment or other suitable object.

The body serves a first purpose of receiving and retaining the key loop, and a second purpose of supporting one or more key loops from another object to which the body is attached. The body has a backing plate 18 with a retainer plate 20 connected thereto at an acute angle to the backing plate. In its simplist embodiment, the backing plate and retainer plate are parts of a single sheet of resilient material that has been folded at crease 22 to form a downwardly opening V-shaped trough, as viewed in FIG. 4, wherein the acute angle at the point of the trough is between 20 and 45 degrees, preferably 30 degrees.

The retainer plate has a free edge 24 opposite from crease 22, and this edge is interrupted by one or more key loop openings 26, each of which may be viewed as having a classic keyhole shape with a trapezoidal passageway immediately adjacent to edge 24 and defined by sides 27 and 28. The greater edge of the trapezoid may be viewed as lying along the line of edge 24, while the opposite shorter edge may be viewed as lying opposite from the greater edge, spaced from the line of edge 24. Sides 27 and 28 are thus convergent from their widest spacing at edge 24 to their narrowest spacing in the direction of crease 22 where the trapezoid terminates and the key loop opening 26 becomes a circular aperture 30 surrounded by side 31, which merges with sides 27 and 28 at its respective opposite ends.

Figure 4:
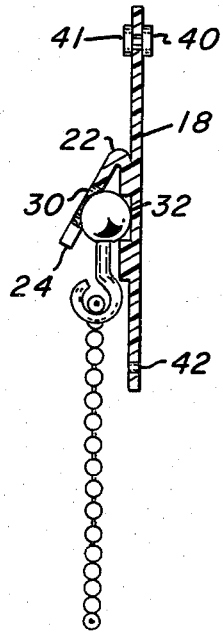
FIG. 4 is a cross-sectional view taken along the plane of line 4—4 of FIG. 3.
Figure 5:
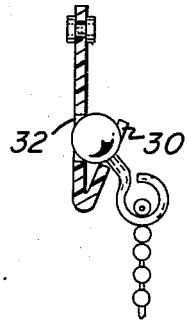
FIG. 5 is a cross-sectional view similar to FIG. 4 but showing a variation in the form of the invention.

The backing plate 18 may have an aperture 32 located approximately oppositely from aperture 30. The purpose of the pair of apertures 30, 32 is to engage head 18 of the key loop. As best shown in FIG. 4 and 5, head 18 is a sphere that is mutually engaged in apertures 30 and 32. The size of the sphere and the size of the apertures are complimentary such that the sphere fits only partially into the apertures, preferably only to the depth corresponding to the thickness of retainer plate 20. The apertures are positioned in such a way that when the sphere is engaged snugly in aperture 30, the aperture 32 will have its normal axis along a radius of the sphere, allowing the sphere to also nest snugly in aperture 32.

The key loop 20 has means for attaching a key or other object thereto, which may include a loop or eye 34 connected to the head by stem 35, and a key chain 36. Head 18 and eye 34 are preferably constructed of metal, although a plastic of suitable strength could be used. For the purposes here disclosed, the size of the head 18 should be at least one-fourth inch in diameter with the preferred size range being from one-fourth to three-eights inch diameter. The apertures 30 and 32 must be slightly smaller in diameter than the sphere, for example one-eighth inch smaller.

Figure 2:
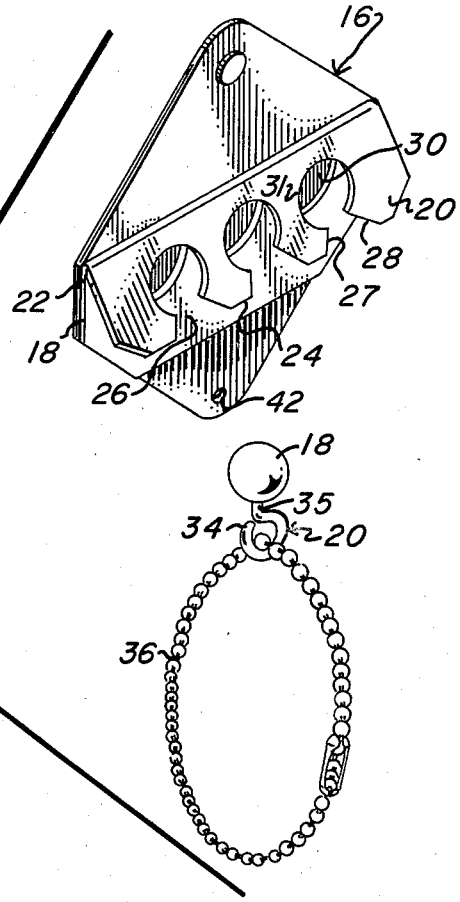
FIG. 2 is an isometric view of the invention.
Figure 3:
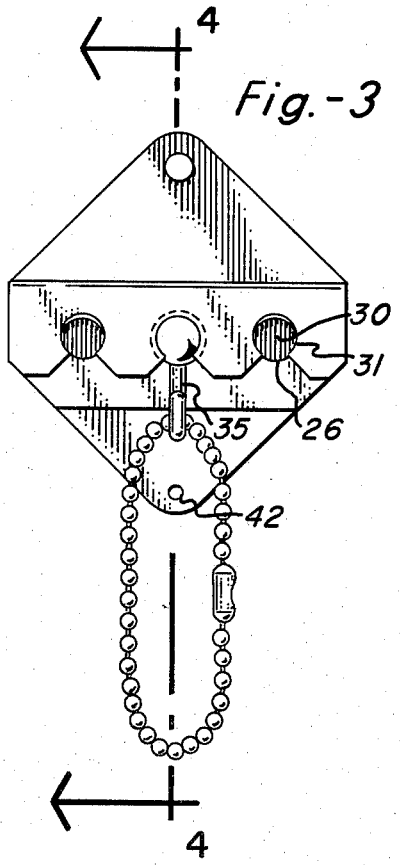
FIG. 3 is a front elevational view of the invention.

In FIGS. 2–4 the means for attaching the backing plate to a garment is disclosed to be a headed pin 40 with a friction clasp 41. The shaft of the pin is adapted to pass through the backing plate and the object to which the keyholder is to be fastened, after which the friction clasp is engaged over the point of the pin. The backing plate may be formed with prelocated holes 42 at the place where the pin is to be inserted. The backing plate of FIGS. 2–4 is shown to be diamond shaped with the pin 40 inserted at the upper point of the diamond, but an additional hole 42 is located at the lower point of the diamond either for an additional pin or for the purpose of allowing the backing plate to be inverted.

FIG. 5 shows the keyholder in inverted position and with a slightly modified backing plate. Crease 22 is now at the lower edge of the keyholder and the V-shaped trough now opens upwardly. Whereas in previously illustrated embodiments the backing plate was shown to have somewhat greater thickness than the retainer plate, the embodiment of FIG. 5 employs material of uniform thickness for both packing and retainer plates.

In use, the keyholder is attached to a garment or purse wall at any desired position, but preferably near the opening of a garment pocket, and the keyholder is affixed at the desired location through use of the pin and friction clamp. Each key loop may have a key or other object attached to chain 36, and the loop is attached to the body by inserting the head 18 in the open end of the V-shaped trough in alignment with a trapezoidal passage. By subsequent force applied to the chain or eye, the sphere is drawn along the passage with the stem 35 extending through the plane of the retainer plate until the sphere is engaged in the aperture 30. The chain and eye may then be allowed to drop and the key will remain suspended from the sphere as engaged in the aperture. In the embodiment of FIGS. 2–4, the nesting of the sphere supports the entire weight of the suspended key, while in FIG. 5 the sphere is additionally supported by the physical presence of the lower part of the V-shaped trough and the stem 35 extends through the aperture 30.

Regardless of whether the V-shaped trough opens upwardly or downwardly, the engagement of the sphere in the apertures 30, 32 is capable of supporting a considerable mass without danger of loss through normal jiggling, as might result from walking. At the same time, there is no difficulty in removing an individual key loop from the body by pulling the chain or eye toward the open end of the V-shaped trough. The ability of the keyholder to operate satisfactorily both in retaining the key loops and in releasing them is attributed in large measure to the size of the sphere 18, which is large enough to require considerable deflection of retainer plate 20 before the sphere is released. Correspondingly, the larger size of the sphere creates a more gradual camming of the retainer plate when the sphere is being removed or replaced so that the entry or exit of the sphere from engagement with the body is relatively smooth and does not involve a sharp snapping operation as would be required if the sphere were of the tiny size employed in the keyholders of the prior art.

Either removal or replacement of a key loop from the keyholder is accomplished by one hand, and no visual inspection is required since the trapezoidal passageways are easily detectable by the fingers or by simply sliding the sphere along the opening of the trough until it engages the passageway. Each key loop is individually removeable without disturbing the remaining loops since local flexing of the retainer plate is possible at the narrow end of the trapezoidal passage to allow the sphere to pass.

The body 16 is preferably constructed of a flexible, resilient plastic material such as nylon or any of several other synthetic materials that are commercially known for use where continued flexibility is desired. The thickness of the material may be approximately one-sixteenth inch. A sheet of such material may be formed with the required crease 22 by exposure to boiling water followed by bending. If the sphere should ever feel loose in the trough, a tight fit can be restored by further exposure to boiling water and repeat bending.

From the provided description, the keyholder will be understood to operate in such a way that each key loop must, of necessity, be removed before the key carried thereon can be used. The removal is sufficiently simple that it creates no problem and requires little attention or concentration, and can be achieved with one hand. The keys or other carried objects are suspended from the keyholder and remain at a distance from the bottom of a pocket or purse. Therefore, keys are predictably located and other objects carried on the keyholder, such as a pocket watch, are not subjected to typical lint and dirt as tends to accumulate in the bottom of pockets.

In construction of the keyholder, certain variations from the embodiment of the drawings is allowable. In particular, the trapezoidal slot may be varied considerably in its configuration. The sides 27 and 28 are preferably at forty-five degrees to the vertical, although a range of thirty to sixty degrees has been found satisfactory. The greater angles weaken the firmness with which the sphere 18 is held in the keyholder, but they make the base of the trapezoid easier to find by tactile means. In the embodiment of FIG. 5, some persons may wish the stem 35 to be more vertical in its depending position. This may be accomplished by creating a small slot radiating downwardly from the aperture 30 to accommodate the stem, but such a slot also tends to weaken the firmness of the hold on the sphere. These and other modifications are then considered to be within the spirit of the invention, which is to be defined by the following claims.

I claim:

1. A pocket organizer comprising:

(a) a body having a backing plate and a retainer plate joined at an acute angle to form a resilient V-shaped trough wherein the retainer plate has a free edge opposite from the apex of the trough;

(b) said retainer plate having at least one key loop opening formed therein having a trapezoidal slot portion and a circular aperture portion, the slot portion having a relatively longer opening at said free edge and having a relatively shorter opening into said circular portion with substantially smooth side edges convergently connecting the free edge to the circular portion, the circular portion having a first predetermined diameter;

(c) said backing plate having a circular cavity therein of second predetermined diameter and positioned such that the normal axis thereto intersects the normal axis of said circular aperture portion;

(d) means for attaching said body to another object; and (e) a key loop having a sphere of at least one-quarter inch diameter and larger than said first and second predetermined diameters, suitably sized to be engaged for retention in and between said circular aperture and said cavity, and having key attaching means connected to the sphere said sphere being retained between the backing plate and retainer plate solely by engagement in said cavity and aperture and suitably sized to pass through said slot portion with resilient flexing of the V-shaped trough, the key attaching means being moveable through substantial arcs both in axial and transverse planes with respect to the V-shaped trough by pivoting of the sphere while engaged in the body.

2. The pocket organizer of claim 1, wherein said acute angle is between twenty and forty-five degrees.

3. The pocket organizer of claim 1, wherein said body has means for attaching to another object located both above and below the opening of said V-shaped trough for mounting the pocket organizer with the trough opening either upwardly or downwardly.

4. The pocket organizer of claim 1, wherein said body is constructed from a plastic material.

5. The pocket organizer of claim 1, wherein said body is formed from an integral single sheet of material.

6. The pocket organizer of claim 1, wherein the facing surfaces of said backing plate and retainer plate are substantially planar.

* * * * *